US006264200B1

(12) United States Patent
Smith

(10) Patent No.: US 6,264,200 B1
(45) Date of Patent: Jul. 24, 2001

(54) METHOD OF PLAYING A ROULETTE-TYPE WAGERING GAME USING PLAYING CARDS

(76) Inventor: Wayne Smith, P.O. Box 847, 12 Marilyn Dr., Caruthersville, MO (US) 63830

( * ) Notice: Subject to any disclaimer, the term of this patent is extended or adjusted under 35 U.S.C. 154(b) by 0 days.

(21) Appl. No.: 09/249,811

(22) Filed: Feb. 16, 1999

(51) Int. Cl.[7] ..... A63F 1/00
(52) U.S. Cl. ..... 273/274; 273/292; 273/306
(58) Field of Search ..... 273/292, 274, 273/309, 306; 463/12, 13

(56) References Cited

U.S. PATENT DOCUMENTS

| | | | | |
|---|---|---|---|---|
| 4,149,728 | * | 4/1979 | Thompson | 273/274 |
| 4,364,567 | * | 12/1982 | Goott | 273/237 |
| 5,098,107 | * | 3/1992 | Boylan et at. | 273/292 |
| 5,184,821 | * | 2/1993 | Korenek | 273/274 |
| 5,772,211 | * | 6/1998 | Nazaryan et al. | 273/292 |

FOREIGN PATENT DOCUMENTS

| | | | | |
|---|---|---|---|---|
| 526357 | * | 10/1921 | (FR) | 273/274 |
| 793745 | * | 1/1936 | (FR) | 273/274 |
| 1448999 | * | 8/1966 | (FR) | 273/274 |

* cited by examiner

*Primary Examiner*—Benjamin H. Layno
(74) *Attorney, Agent, or Firm*—Larson & Taylor, PLC

(57) ABSTRACT

A method of playing a roulette-type wagering game between a player or a group of players uses randomly generated playing cards having various worths as well as a nullity card. Preferably, the playing cards are a standard 52 card deck of cards and three cards are dealt as a series, with the center card of the series being designated as a single card as well. The first step is the offering of a plurality of outcomes on which each respective player wagers against a dealer. The outcomes offered are: (a) that the series of cards dealt by the dealer has a predetermined combination worth, where the combination worth of the series is a nullity if the nullity card is one of the series; and (b) that the single card dealt by the dealer has a predetermined single card worth. An ante is then wagered by each respective player against the dealer for one or more selected outcomes of the series and/or single card dealt by the dealer. The dealer then deals the series (and hence the single card) to determine the game outcome. The dealer next determines, for each respective player, that each ante wagered on the series or single card dealt is a winner or a loser, and pays off any winning wager to the respective player. Various outcomes are available to be wagered upon.

20 Claims, 2 Drawing Sheets

METHOD OF PLAYING A ROULETTE-TYPE WAGERING GAME USING PLAYING CARDS

FIELD OF THE INVENTION

The present invention relates generally to a method for playing a wagering game, and in particular to a roulette-type wagering game in which randomly generated playing cards are used to determine the outcome of roulette-types of wagers.

BACKGROUND OF THE INVENTION

In a standard roulette game using a wheel or bowl, one number/color is selected during each play of the game. Many people are intrigued or attracted to the roulette game by the seeming very close to even money bets provided for such games, such as for bets of red or black, or odd or even. However, while attracted by the close to even bets available, some people are not especially comfortable playing a game where a spinning wheel or bowl is used to determine the outcome. On the other hand, most people are comfortable with, and familiar with, card games and these people are attracted to such games due to the familiarity with such cards.

SUMMARY OF THE INVENTION

In accordance with the present invention, a method of playing a roulette-type wagering game between a player or a group of players and a dealer where outcomes of the game are determined by randomly generated playing cards having various worths as well as a nullity card is provided. Preferably, the playing cards are a standard 52 card deck of cards, but this is not necessary. The method comprises a first step of offering of a plurality of outcomes on which each respective player wagers against a dealer. The outcomes offered are: (a) that a series of cards dealt by the dealer have a predetermined combination worth, where the combination worth of the series is a nullity if the nullity card is one of the series; and preferably (b) that a single card dealt by the dealer has a predetermined single card worth. An ante is then wagered by each respective player against the dealer for one or more selected outcomes of the series or single card dealt by the dealer. The dealer then deals the series and single card to determine the game outcome. The dealer next determines, for each respective player, that each ante wagered on the series dealt by the dealer is a winner or a loser, and pays off any winning wager to the respective player. At the same time, or before or after, the dealer also determines, for each respective player, that each ante wagered on the single card dealt by the dealer is a winner or a loser, and pays off of any winning wager to the respective player.

Preferably, the playing cards, except the nullity card, have equal numbers of two different colors, as red and black in a standard 52 card deck. Then, the offering step includes the offering of an outcome that the series has a worth of: (a) a majority of the cards being the same red or black color, and (b) all of the cards being the same red or black color. Also preferably, the playing cards, except the nullity card, have equal numbers of different consecutive numerical ranks, as ace-king of the standard 52 card deck. Then, the offering step includes the offering of an outcome that the series have a worth of: (a) an odd or even sum of the ranks, and (b) a sum which is less than or greater than a predetermined numerical sum. Where the playing cards, except the nullity card, are a standard deck of 52 cards, the offering step further includes the offering of an outcome that the series has a worth of: (a) two of the same rank, (b) all of the same suit, (c) all of consecutive ranks, (d) all of the same rank, (e) all of consecutive ranks having the same suit, and (f) a nullity.

In one preferred embodiment, the offering step also includes the offering of an outcome that the single card has a worth of:

(a) one of the groups of (i) 2, 3, 4, 5, 6, or 7, or (ii) 8, 9, 10, jack, queen, or king; (b) one of the groups of (i) 2, 3, 4, or 5, (ii) 6, 7, 8, or 9, or (iii) 10, jack, queen, or king; and (c) a selected one of the groups of ace, 2, 3, 4, 5, 6, 7, 8, 9, 10, jack, queen, king, or 0 (for the nullity card). In another preferred embodiment, the offering step includes the offering of an outcome that the single card has a worth of (a) one of a plurality of groups of six predetermined cards; (b) one of a plurality of groups of four predetermined cards; (c) one of a plurality of groups of three predetermined cards; (d) one of a plurality of groups of two predetermined cards; and (e) one of the group of ace, 2, 3, 4, 5, 6, 7, 8, 9, 10, jack, queen, king, or a nullity.

Also in the preferred embodiment, the ace is considered to have a numerical value of one, while the jack the queen and the king are all considered to have a numerical value of ten. Then, the series has three cards therein and the predetermined sum is twenty. More preferably, the single card is a center one of the three series cards dealt.

It is an advantage of the present invention that a method of playing a playing card game in which the same close to even money bets of a roulette game are offered to the players is provided.

It is also an advantage of the present invention that a method of playing a roulette-type game using a standard 52 card deck with which most players are familiar and comfortable is provided.

It is a further advantage of the present invention that a method of playing a wagering game which people are attracted to and which is easy to understand is provided.

It is a still further advantage of the present invention that a method of playing a wagering game in which numerous opportunities for players to bet on different outcomes at the same time are present.

Yet another advantage of the present invention is that a method of playing a roulette-type game provides two different sets of outcomes to bet upon, one set based on a series of (preferably three) cards and the other set based on a single (preferably center of the three) card dealt when the series of cards is dealt.

Other features and advantages of the present invention are stated in or apparent from detailed descriptions of presently preferred embodiments of the invention found hereinbelow.

DESCRIPTION OF THE PREFERRED EMBODIMENTS

Figure 1:
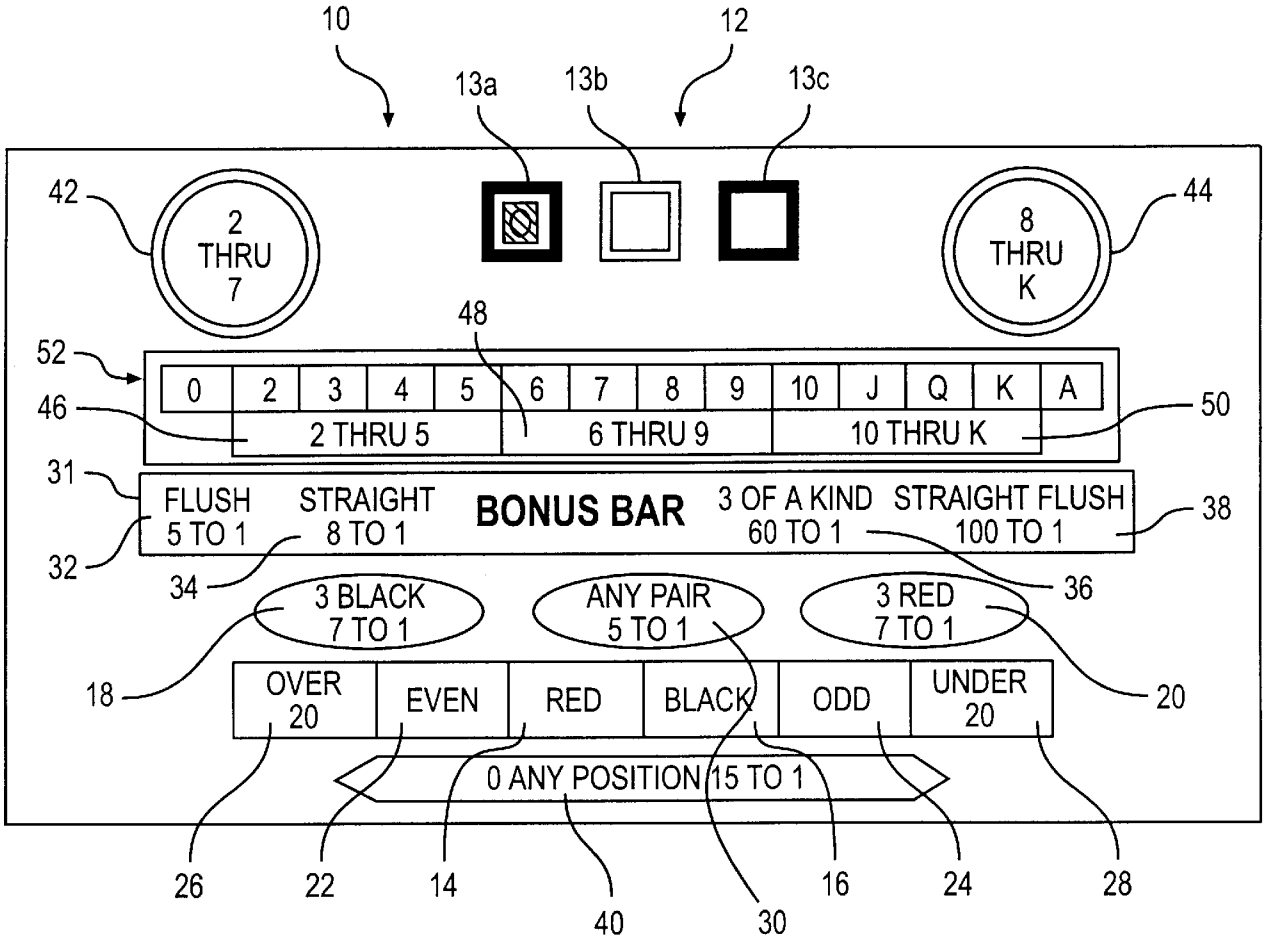
FIG. 1 is a schematic table layout which is conveniently used in the method of playing a three card roulette-type playing card game of the present invention.

With reference now to the drawings in which like numerals represent like elements, a first preferred embodiment of a table layout 10 which is conveniently used in the method of playing a wagering game of the present invention is schematically depicted in FIG. 1. The dealer and banker of the game is preferably located at the head 12 of the table layout, and the plurality of players are then located about the other three (or more, if desired) sides of the table layout.

It will initially be appreciated that the method of playing a roulette-type card game of the present invention is preferably played with a single standard 52 card deck of playing cards. As well known in the art, this deck includes four suits of cards (two suits of red color, diamonds and hearts; and two suits of black color, clubs and spades), and each suit has each card with a different rank (ranked in order from two, three through queen, king, with the ace either one and/or above the king). While the standard 52 card deck is preferred due to its familiarity, those of ordinary skill will appreciate that other decks having more or less cards (as by more or less suits and/or more or less ranks) are also possible depending on the desires of the dealer (or banker/owner where the game is played). The important aspect of these cards is simply that they must have some various worths, both by themselves and in combination, and that the worths are readily identified by the players.

It will also be appreciated that in addition to the deck of cards, the method of the present invention requires that there is added thereto one (or more if desired) additional card termed a "nullity" card hereafter. The nullity card is preferably designated with a "0", and is advantageously colored different from the other cards of the deck as by having a green background or the like so as to be easily recognized as shown in box 13*a* of FIG. 1. The nullity card serves to render any combination of cards therewith to have a null (zero) worth or value.

In the preferred embodiment of the method of playing the game, the cards of the deck are shuffled after each game or hand by the dealer. However, if a plurality of decks are used, with a corresponding plurality of nullity cards, shuffling can occur less frequently as desired and well known in the art. After shuffling, or more likely after the last hand or game has ended and during the shuffling, the dealer offers each player the opportunity to bet an ante on one or more of the plurality of various outcomes of the next hand or game as presented on layout 10. Some, but preferably not all, of the outcomes are based on various combinations of a series of three (preferably) cards to be dealt by the dealer and presented on layout 10 in boxes 13*a*, 13*b*, and 13*c*. It will be appreciated that box 13*b* is further designated as the center box and that center box 13*b* has a different appearance from boxes 13*a* and 13*c* for reasons to be discussed subsequently. While three cards is preferably the number of cards to be dealt each hand or game, those of ordinary skill will appreciate that more or less cards could be dealt, with corresponding changes in the outcomes presented to be bet upon and the payoffs therefor. However, the dealing of exactly three cards is preferred for simplicity, both in understanding of the game by the players and of the (approximate) odds offered on each bet by the players—much like in a roulette game and the wagers thereof.

Where three cards are to be dealt each game, various outcomes of the combined worths or values of the three cards are offered to be bet upon using suitable tokens or the like (including the use of multiple tokens for each bet and/or tokens of differing denominations). For convenience, some of the differing outcomes are hereafter grouped together, as an outcome of one group excludes the outcome(s) of the other group(s) associated therewith. While each and every outcome of associated groups can be bet upon, typically a player will chose only one from each associated group to bet upon as well appreciated by those of ordinary skill. With the presently preferred embodiment, the number cards of the standard 52 card deck have a numerical value the same as the number; while the ace has a numerical value of one, and the face cards (jack, queen and king) have numerical values of ten (for simplicity of calculation, as will be apparent hereafter).

The various outcomes preferably offered according to the present invention are as follows.

1. Majority color group. A bet is made that the majority of the cards dealt, in the preferred case two out of three, will have either a red color or a black color. Majority color bets are made by placing a suitable token in an associated "Red" block 14 or "Black" block 16 of layout 10.

2. All color group. A bet is made that all of the cards dealt, in the preferred case all three, will have a red or a black color. All color bets are made by placing a suitable token in an associated "3 Black" block 18 or "3 Red" block 20 of layout 10.

3. Odd/Even group. A bet is made that the total of the numerical values of the cards dealt, in the preferred case the three cards in boxes 13*a*, 13*b*, and 13*c*, will be either odd or even. Odd/even bets are made by placing a suitable token in an associated "Even" block 22 or "Odd" block 24 of layout 10.

4. Sum group. A bet is made that the total of the numerical values of the cards dealt, in the preferred case three, will be less than or greater than a predetermined value. In the preferred case of three cards being dealt, the predetermined value is twenty, but obviously for greater or lesser cards dealt different predetermined values would have to be chosen. It will be noted that the sum of twenty itself is not offered to increase the house percentage. The sum bets are made by placing a suitable token in an associated "Over 20" block 26 or "Under 20" block 28 of layout 10.

5. Pair. A pair bet is made that two of the cards dealt will have the same value or rank. A pair bet is made by placing a suitable token in an "Any Pair" block 30 of layout 10.

6. Bonus Group. A "bonus" bet is made that the three cards dealt will have any one the various predetermined outcomes, which by design are those which are generally rarely likely to occur. By themselves, such outcomes might not generate much interest due to the unlikely occurrence thereof, but by grouping these outcomes together in a single wager, the chances of one of the outcomes occurring is much higher and thus such a wager attracts greater interest. Of course, the odds for the payoff of each outcome must be selected based on the fact that the outcome is only one of a group of outcomes which are possible with only a single wager. A bonus bet is made on any of the outcomes by placing a suitable token anywhere in a bonus box 31 of layout 10. The outcomes offered, and the payoffs for each outcome, are as shown on layout 10. Those outcomes are as follows.

6a. Flush. A flush outcome is achieved where all of the cards dealt are the same suit. The flush outcome and payoff odds are designated on layout 10 in a "Flush" area 32 of bonus box 31.

6b. Straight. A straight outcome is achieved where all of the cards can be arranged in consecutive values or ranks. A straight outcome and payoff are designated on layout 10 in a "Straight" area 34 of bonus box 31.

6c. Triple. A triple outcome is achieved where three of all of the cards dealt have the same value or rank. In the preferred case where only three cards are dealt, this means that all cards dealt would have to have the same rank. A triple outcome and payoff are designated on layout 10 in a "3 of a Kind" area 36 of bonus box 31.

6d. Straight Flush. A straight flush bet is made that all of the cards can be arranged in consecutive values or ranks and that all of the cards are of the same suit. A straight flush outcome and payoff are designated on layout 10 in a "Straight Flush" area 38 of bonus box 31.

7. Nullity. A nullity bet is made that the nullity card will be one of the cards dealt, so that the combination value of the cards will be a nullity (as noted above). A nullity bet is made by placing a suitable token in a "0 Any Position" block 40 of layout 10.

Preferably, all of the outcomes discussed above are offered, as the larger the number of choices the more the players are likely to bet and hence the more the dealer/banker is likely to earn. However, it will be appreciated that for additional simplicity, only some of the outcomes discussed above might be offered. For example, for a simple and very quick game, just the majority color and all color outcomes could be offered. If some additional outcomes are desired besides these two groups, the outcomes of the odd/even group and of the sum group could be added with little increase in complexity. However, it is preferred that all of the outcomes noted above be offered to provide the widest selection to the players and to afford the most opportunities to bet on more than one group of outcomes since all outcomes are simple to understand (especially as they are similar to roulette outcomes).

Besides offering outcomes on the combination values of the series of cards dealt, in the preferred embodiment of the method of play of the present invention, offers to wager on the "center" card dealt to the center box 13*b* in FIG. 1 are also made. By offering wagers on the center card, opportunities to wager a second kind of bet on a different set of outcomes is presented to the players. While the offering of wagers on the center card does complicate the game somewhat and might not be preferred for some games or by some players, the outcomes offered are easily understood and are not complicated. For that reason, and the fact that additional opportunities to wager represent additional income for the dealer or banker, the preferred embodiment of the method of play of the present invention provides this offer.

With reference to FIG. 1, the outcomes offered, also grouped together where appropriate, are as follows.

1. High/Low SIX Card Group. A high/low wager is made that the center card will have a numerical value in one of the following groups of six cards: (i) 2, 3, 4, 5, 6, or 7, or (ii) 8, 9, 10, jack, queen or king. It will be noted that the ace is not in either of the groups, providing an additional house advantage. A high/low bet is made by placing a suitable token in an associated "2 Thru 7" block 42 or "8 Thru K" block 44 of layout 10.

2. High/Middle/Low FOUR Card Group. A high/middle/low wager is made that the center card will have a numerical value in one of the following groups of four cards: (i) 2, 3, 4, or 5, (ii) 6, 7, 8, or 9, or (iii) 10, jack, queen or king. It will be noted that the ace is not in any of the groups, providing an additional the house advantage. A high/middle/low bet is made by placing a suitable token in an associated "2 Thru 5" block 46 , "6 Thru 9" block 48, or "10 Thru K" block 50 of layout 10.

3. Specific Rank Group. A specific rank wager is made that the center card will have a specific value of 0 (for the nullity card), 2, 3, 4, 5, 6, 7, 8, 9, 10, J (jack), Q (queen), K (king), or A (ace). It will be noted that the nullity card is part of this group, so that every possible outcome can be bet on (with the nullity card outcome having an increased payoff as discussed subsequently). A specific rank bet is made by placing a suitable token in an associated block of the series 52 of blocks of layout 10.

Figure 2:
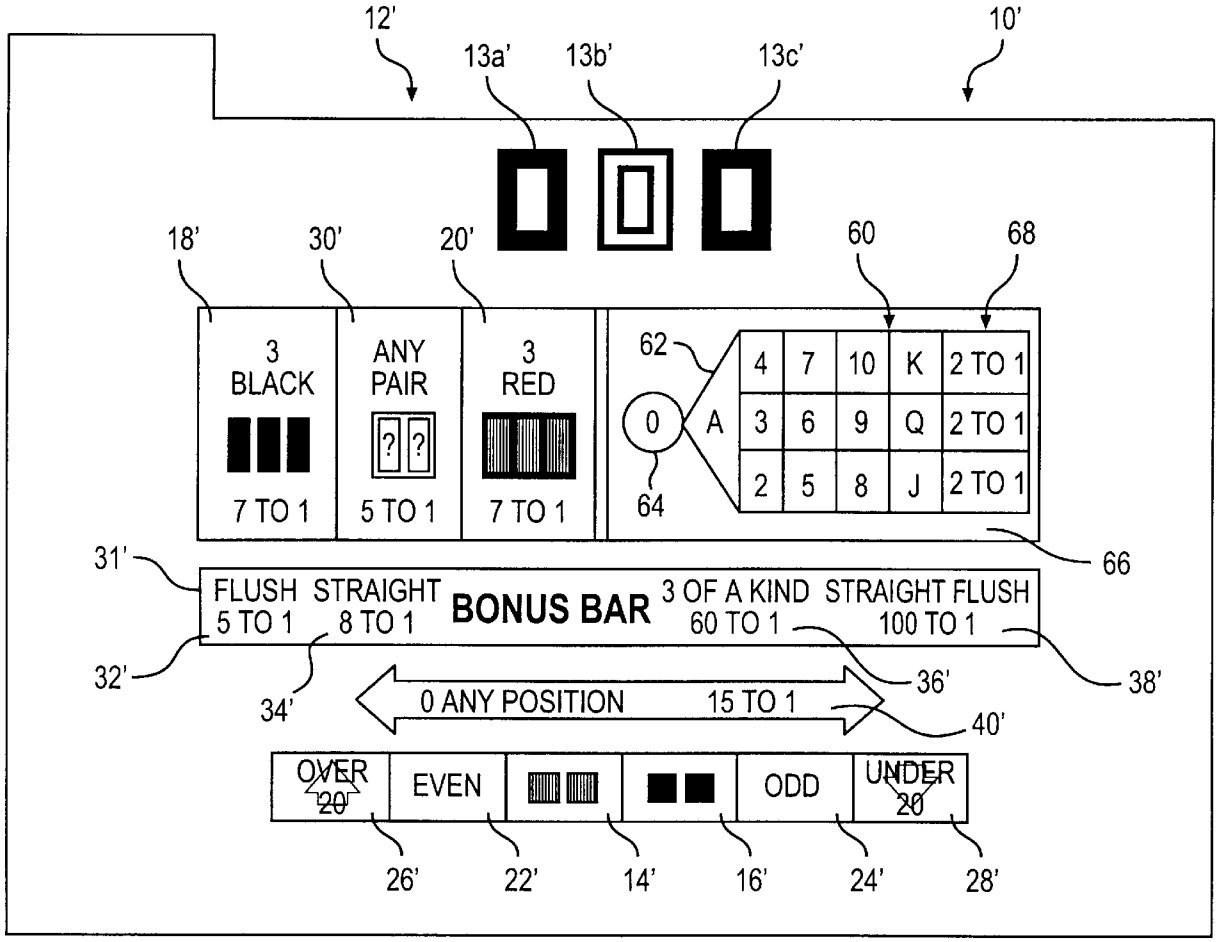
FIG. 2 is an alternative schematic table layout which is conveniently used in the method of playing a three card roulette-type playing card game of the present invention.

Depicted in FIG. 2 is a table layout 10' which is conveniently used in an alternative method of playing a wagering game of the present invention. As this alternative layout 10' is similar in many respects to layout 10, the same reference numbers used in FIG. 1 will be used in FIG. 2 but with a "prime" to identify similar elements. The similar elements of layout 10' differ from those of FIG. 1 primarily by position and appearance, but substantively remain the same. For that reason, the similar elements will not be discussed in detail further.

The primary difference in the method of playing the wagering game of the present invention from the previous embodiment is the variety of bets offered for the card placed in center box 13*b*'. With layout 10', rather than a series 52 of individual card boxes for each rank of card as in layout 10, there is instead a 3×4 matrix 60 of individual card boxes for each rank of cards 2 through king, and adjacent boxes 62 and 64 for the ace rank and nullity card, respectively. It will appreciated that there is a border below and to the right of matrix 60, as well as row and column lines separating the various cell ranks identified in matrix 60, and that this layout is similar to that used in some standard roulette games.

With reference therefor now to FIG. 2, the outcomes offered, also grouped together where appropriate, for the single card are as follows.

1. One of SIX Cards Group. This is a variation of the High/Low group of layout 10, in that the same offer is made that the center card will have a numerical rank in the same predetermined high low groups, as well as an offer for a third predetermined group. The three groups are (i) 2 through 7, (ii) 8 through king, or (iii) 5 through 10. Obviously, the new group of 5–10 affords the player another group to bet from than was offered with the High/Low group. A bet for one of these groups is made by placing a suitable token along the border 66 adjacent a common column line of any two adjacent columns of the identified ranks.

2. One of FOUR Cards Group. This is a variation of the High/Middle/Low group of layout 10, in that the same offer is made that the center card will have a numerical rank in groups having the same number of cards (four). However, this group has nine possible outcomes offered for additional variety. The nine groups are (i) 2, 3, 5, or 6, (ii) 3, 4, 6, or 7, (iii) 5, 6, 8, or 9, (iv) 6, 7, 9, or 10, (v) 8, 9, J, or Q, (vi) 9, 10, Q, or K, (vii) 2, 5, 8, or J, (viii) 3, 6,9, or Q, and (ix) 4, 7, 10, or K. A bet for one of these groups is made by placing a suitable token at the crossing point of the row line and column line forming a "+" with the identified ranks in the four corners thereof for groups (i) to (vi) and/or by placing a suitable token in an appropriate one of the row 68 of blocks identifying the odds to the right of the three rows of matrix 60 for groups (vii) to (ix).

3. One of THREE Cards Group. This is a variation of the above groups, except that the offer is made that the center card will have a numerical value in groups having three predetermined consecutive ranks. There are four possible outcomes offered, and the four groups are: (i) 2, 3, or 4, (ii) 5, 6, or 7, (iii) 8, 9, or 10, and (iv) J, Q, or K. A bet for one of these groups is made by placing a suitable token in border 66 directly below the column containing the identified ranks.

4. One of TWO Cards Group. This is another variation of the above groups, except that the offer is made that the center card will have a numerical value in predetermined groups of only two cards. This group has seventeen possible outcomes offered for variety. The seventeen groups are (i) 2 or 5, (ii) 3 or 6, (iii) 4 or 7, (iv) 5 or 8, (v) 6 or 9, (vi) 7 or 10, (vii) 8 or J, (viii) 9 or Q, (ix) 10 or K, (x) 2 or 3, (xi) 3 or 4, (xii) 5 or 6, (xiii) 6 or 7, (xiv) 8 or 9, (xv) 9 or 10, (xvi) J or Q, and (xvii) Q or K. A bet for one of these groups is made by placing a suitable token on the adjoining column line for bets (i) through (ix) and on the adjoining row line for bets (x) through (xvii).

5. Specific Rank Group. A specific rank wager is made that the center card will have a specific value of 0 (for the nullity card), 2, 3, 4, 5, 6, 7, 8, 9, 10, J (jack), Q (queen), K (king), or A (ace)—in the same manner as with layout 10. As with layout 10, it will be noted that the nullity card is part of this group, so that every possible outcome can be bet on (with the nullity card outcome having an increased payoff as discussed subsequently). A specific rank bet is made by placing a suitable token in an associated block of the matrix 60 and/or blocks 62 and 64 of layout 10'.

While use of the center card as a single card whose outcome is bet on is preferred in both embodiments, it will be appreciated that another card besides that of the series of (preferably three) cards which determine the combination worth can be dealt. By dealing a separate single card from the series of three cards, some additional complexity is added to the game as well as time spent. For those reasons, the use of the center card for determining the outcomes of the single card wagers is preferred.

For the preferred methods of playing a wagering game of the present invention where three cards are dealt by the dealer and the single card is the center card of the three cards dealt, suggested payoff odds for each outcome are as listed in the tables below (one for the series card wager and one for the center/single card wager) together with the percentage occurrence of each outcome. It will be appreciated by those of ordinary skill that the house advantage for certain outcomes is obtained or increased by use of the nullity card. For convenience of the players, some payoffs are preferably listed on layout 10 or 10' in the associated blocks in order to heighten player interest.

BETS ON SERIES OF CARDS

| OUTCOME | % OCCURENCE | PAYOFF ODDS |
|---|---|---|
| 2 Black | 47.17 | 1:1 |
| 2 Red | 47.17 | 1:1 |
| Even | 47.13 | 1:1 |
| Odd | 47.21 | 1:1 |
| Under 20 | 44.80 | 1:1 |
| Over 20 | 43.25 | 1:1 |
| Pair | 16.20 | 5:1 |
| 3 Black | 11.10 | 7:1 |
| 3 Red | 11.10 | 7:1 |
| 0 Any Position | 5.66 | 15:1 |

BETS ON SERIES OF CARDS

| | | |
|---|---|---|
| Flush | 4.68 | 5:1 |
| Straight | 3.07 | 8:1 |
| 3 of a Kind | 0.22 | 80:1 |
| Straight Flush | 0.16 | 100:1 |

BETS ON SINGLE CARD

| OUTCOME | % OCCURENCE | PAYOFF ODDS |
|---|---|---|
| 1 of SIX cards | 45.28 | 1:1 |
| 1 of FOUR cards | 30.19 | 2:1 |
| 1 of THREE cards | 22.64 | 3:1 |
| 1 of TWO cards | 15.09 | 5:1 |
| Specific Rank (2 through ace) | 7.55 | 11:1 |
| 0 Card | 1.89 | 47:1 |

After shuffling and announcing that betting is closed, the dealer proceeds to deal the designated number of cards on layout 10 or 10'. In the preferred embodiments, the number of cards is three, and they are dealt in order in respective boxes 13*a*, 13*b* and 13*c*. Once the cards are dealt, the dealer immediately determines which bets made by the respective players are winners or losers. All losing bets are immediately collected by the dealer, and then winning bets are paid out to the respective players according the predetermined schedule posted on layout 10 or elsewhere, such as the schedules set forth above.

While the present invention has been described with respect to exemplary embodiments thereof, it will be understood by those of ordinary skill in the art that variations and modifications can be effected within the scope and spirit of the invention.

I claim:

1. A method of playing a roulette-type wagering game between a group of players and a dealer where outcomes of the game are determined by randomly generated playing cards having various worths as well as a nullity card, wherein the playing cards, except the nullity card, are selected from a standard deck of 52 cards, and the nullity card is different from each of the 52 cards of the standard deck, said method comprising the steps of:

offering of a plurality of outcomes on which each respective player wagers against a dealer, the outcomes offered being:

(a) that a series of cards dealt by the dealer to the dealer have a predetermined combination worth, where the combination worth of the series is a nullity if the nullity card is one of the series; and (b) that a single card dealt by the dealer to the dealer has a predetermined single card worth;

wagering of an ante by each respective player against the dealer for at least one selected outcome of the series or single card dealt by the dealer to the dealer;

dealing of the series and single card by the dealer to the dealer;

determining, for each respective player, that each ante wagered on the series dealt by the dealer to the dealer is a winner or a loser, and paying off of any winning wager to the respective player; and determining, for each respective player, that each ante wagered on the single card dealt by the dealer to the dealer is a winner or a loser, and paying off of any winning wager to the respective player.

2. A method of playing a roulette-type wagering game as claimed in claim 1:

wherein the playing cards, except the nullity card, have equal numbers of two different colors;

wherein said offering step includes the offering of an outcome that the series has a worth of (a) a majority of the cards being the same color, and
(b) all of the cards being the same color.

3. A method of playing a roulette-type wagering game as claimed in claim 2:

wherein the playing cards, except the nullity card, have equal numbers of different consecutive numerical ranks;

wherein said offering step includes the offering of an outcome that the series have a worth of
(a) an odd or even sum of the ranks, and
(b) a sum which is less than or greater than a predetermined numerical sum.

4. A method of playing a roulette-type wagering game as claimed in claim 3:

wherein said offering step includes the offering of an outcome that the series has a worth of
(a) two of the same rank,
(b) all of the same suit,
(c) all of consecutive ranks,
(d) all of the same rank,
(e) all of consecutive ranks having the same suit, and
(f) a nullity.

5. A method of playing a roulette-type wagering game as claimed in claim 4:

wherein said offering step includes the offering of an outcome that the single card has a worth of
(a) one of a plurality of groups of six predetermined cards;
(b) one of a plurality of groups of four predetermined cards; and
(c) one of the group of ace, 2, 3, 4, 5, 6, 7, 8, 9, 10, jack, queen, king or a nullity.

6. A method of playing a roulette-type wagering game as claimed in claim 5:

wherein the ace is considered to have a numerical value of one, and wherein the jack, the queen and the king are considered to have a numerical value of ten; and wherein the series has three cards therein and the predetermined sum is twenty.

7. A method of playing a roulette-type wagering game as claimed in claim 6:

wherein the single card is a center one of the three cards.

8. A method of playing a roulette-type wagering game as claimed in claim 1:

wherein said offering step includes the offering of an outcome that the single card has a worth of
(a) one of a plurality of groups of six predetermined cards;
(b) one of a plurality of groups of four predetermined cards;
(c) one of a plurality of groups of three predetermined cards;
(d) one of a plurality of groups of two predetermined cards; and
(e) one of the group of ace, 2, 3, 4, 5, 6, 7, 8, 9, 10, jack, queen, king, or a nullity.

9. A method of playing a roulette-type wagering game between a group of players and a dealer where outcomes of the game are determined by randomly generated playing cards having various ranks and suits as well as a nullity card, wherein the playing cards, except the nullity card, are selected from a standard deck of 52 cards, and the nullity card is different from each of the 52 cards of the standard deck, said method comprising the steps of:

offering of a plurality of outcomes on which each respective player wagers against a dealer, the outcomes offered being:
(a) that three cards dealt by the dealer to the dealer have a predetermined combination worth, where the combination worth of the three cards is a nullity if the nullity card is one of the three cards; and
(b) that a center card of the three cards dealt by the dealer to the dealer has a predetermined single card worth;

wagering of an ante by each respective player against the dealer for at least one selected outcome of the three cards or center card dealt by the dealer to the dealer;

dealing of three cards in a row by the dealer to the dealer;

determining, for each respective player, that each ante wagered on the three cards dealt by the dealer to the dealer is a winner or a loser, and paying off of any winning wager to the respective player; and determining, for each respective player, that each ante wagered on the center card dealt by the dealer to the dealer is a winner or a loser, and paying off of any winning wager to the respective player.

10. A method of playing a roulette-type wagering game as claimed in claim 9:

wherein the playing cards, except the nullity card, have equal numbers of two different colors;

wherein said offering step includes the offering of an outcome that the three cards have a worth of
(a) two out of the three cards being a first or a second color, and
(b) three out of the three cards being the first or the second color.

11. A method of playing a roulette-type wagering game as claimed in claim 10:

wherein the playing cards, except the nullity card, have equal numbers of different consecutive numerical ranks;

wherein said offering step includes the offering of an outcome that the three cards have a worth of
(a) an odd or even sum of the ranks, and
(b) a sum which is less than or greater than a predetermined numerical sum.

12. A method of playing a roulette-type wagering game as claimed in claim 11:

wherein said offering step includes the offering of an outcome that the three cards have a worth of
(a) two of the same rank,
(b) three of the same suit,
(c) three consecutive ranks,
(d) three of the same rank,
(e) three of consecutive ranks having the same suit, and
(f) a nullity.

13. A method of playing a roulette-type wagering game as claimed in claim 12:

wherein the ace is considered to have a numerical value of one, wherein the jack, the queen and the king are considered to have a numerical value of ten; and wherein the predetermined sum is twenty.

14. A method of playing a roulette-type wagering game as claimed in claim 13:

wherein said offering step includes the offering of an outcome that the center card has a worth of
(a) one of a plurality of groups of six predetermined cards;
(b) one of a plurality of groups of four predetermined cards; and
(c) one of the group of ace, 2, 3, 4, 5, 6, 7, 8, 9, 10, jack, queen, king, or a nullity.

15. A method of playing a roulette-type wagering game as claimed in claim 9:

wherein said offering step includes the offering of an outcome that the center card has a worth of (a) one of a plurality of groups of six predetermined cards;

(b) one of a plurality of groups of four predetermined cards;

(c) one of a plurality of groups of three predetermined cards;

(d) one of a plurality of groups of two predetermined cards; and (e) one of the group of ace, 2, 3, 4, 5, 6, 7, 8, 9, 10, jack, queen, king, or a nullity.

16. A method of playing a roulette-type wagering game between a group of players and a dealer where outcomes of the game are determined by randomly generated playing cards from a standard deck of 52 cards which also includes a nullity card, said method comprising the steps of:

offering of a plurality of outcomes on which each respective player wagers against a dealer, the outcomes offered being that three cards dealt by the dealer to the dealer have a predetermined combination worth, where the combination worth of the three cards is a nullity if the nullity card is one of the three cards, the combination of outcomes including that the three cards have a worth of (a) two out of the three cards being of a red or a black color, (b) three out of the three cards being the red or the black color, (c) an odd or even sum of the ranks, and (d) a sum which is less than or greater than a predetermined numerical sum;

wagering of an ante by each respective player against the dealer for at least one selected outcome of the three cards dealt by the dealer to the dealer;

dealing of three cards in a row by the dealer to the dealer; and determining, for each respective player, that each ante wagered on the three cards dealt by the dealer to the dealer is a winner or a loser, and paying off of any winning wager to the respective player.

17. A method of playing a roulette-type wagering game as claimed in claim 16:

wherein said offering step further includes the offering of an outcome that the three cards have a worth of (a) two of the same rank, (b) three of the same suit, (c) three consecutive ranks, (d) three of the same rank, (e) three of consecutive ranks having the same suit, and (f) a nullity.

18. A method of playing a roulette-type wagering game as claimed in claim 17:

wherein the ace is considered to have a numerical value of one, wherein the jack, the queen and the king are considered to have a numerical value of ten; and wherein the predetermined sum is twenty.

19. A method of playing a roulette-type wagering game as claimed in claim 18:

wherein said offering step further includes the offering of an outcome that the center card has a worth of (a) one of a plurality of groups of six predetermined cards;

(b) one of a plurality of groups of four predetermined cards; and (c) one of the group of ace, 2, 3, 4, 5, 6, 7, 8, 9, 10, jack, queen, king, or a nullity.

20. A method of playing a roulette-type wagering game as claimed in claim 16:

wherein said offering step further includes the offering of an outcome that the center card has a worth of (a) one of a plurality of groups of six predetermined cards;

(b) one of a plurality of groups of four predetermined cards;

(c) one of a plurality of groups of three predetermined cards;

(d) one of a plurality of groups of two predetermined cards; and (e) one of the group of ace, 2, 3, 4, 5, 6, 7, 8, 9, 10, jack, queen, king, or a nullity.

* * * * *